US008272206B2

(12) United States Patent
Lee et al.

(10) Patent No.: US 8,272,206 B2
(45) Date of Patent: Sep. 25, 2012

(54) APPARATUS FOR PLASMA REACTION AND SYSTEM FOR REDUCTION OF PARTICULATE MATERIALS IN EXHAUST GAS USING THE SAME

(75) Inventors: Dae-hoon Lee, Yuseong-gu (KR); Kwan-tae Kim, Seo-gu (KR); Young-hoon Song, Yuseong-gu (KR); Min-suk Cha, Yuseong-gu (KR); Jae-ok Lee, Yuseong-gu (KR)

(73) Assignee: Korea Institute of Machinery & Materials, Daejeon (KR)

( * ) Notice: Subject to any disclaimer, the term of this patent is extended or adjusted under 35 U.S.C. 154(b) by 1079 days.

(21) Appl. No.: 12/090,565

(22) PCT Filed: Jul. 12, 2007

(86) PCT No.: PCT/KR2007/003394

§ 371 (c)(1),
(2), (4) Date: Apr. 17, 2008

(87) PCT Pub. No.: WO2008/016225

PCT Pub. Date: Feb. 7, 2008

(65) Prior Publication Data

US 2008/0276600 A1 Nov. 13, 2008

(30) Foreign Application Priority Data

Aug. 1, 2006 (KR) ..... 10-2006-0072721
Oct. 27, 2006 (KR) ..... 10-2006-0104786
Dec. 15, 2006 (KR) ..... 10-2006-0128415

(51) Int. Cl.
*F01N 3/00* (2006.01)
*B01J 19/08* (2006.01)
*B01J 19/12* (2006.01)

(52) U.S. Cl. ..... 60/275; 422/186.04

(58) Field of Classification Search ..... 60/275; 422/186.04
See application file for complete search history.

(56) References Cited

U.S. PATENT DOCUMENTS 4,404,795 A * 9/1983 Oishi et al. ..... 60/274
(Continued)

FOREIGN PATENT DOCUMENTS

JP 59 25024 2/1984
(Continued)

OTHER PUBLICATIONS

English translation of KR 100522168.*
(Continued)

*Primary Examiner* — Binh Q Tran
*Assistant Examiner* — Jason Shanske
(74) *Attorney, Agent, or Firm* — Oblon, Spivak, McClelland, Maier & Neustadt, L.L.P.

(57) ABSTRACT

A reduction system for particulate materials in exhaust gas, which is connected to a tailpipe of an engine that burns a hydrocarbon-based fuel supplied from a fuel storage tank, and collects and removes particulate materials within the exhaust gas, may include a plasma reactor having a gas inlet and an outlet, and a DPF (diesel particulate filter) trap having a filter. The tailpipe of the engine may communicate with the gas inlet of the plasma reactor, and the outlet of the plasma reactor may communicate with the DPF trap. The exhaust gas exhausted from the engine may be transferred to the DPF trap after being heated while passing through the plasma reactor.

15 Claims, 16 Drawing Sheets

U.S. PATENT DOCUMENTS

| | | | | |
|---|---|---|---|---|
| 5,826,428 | A * | 10/1998 | Blaschke | 60/303 |
| 5,951,771 | A * | 9/1999 | Raney et al. | 118/723 ER |
| 6,176,078 | B1 * | 1/2001 | Balko et al. | 60/274 |
| 6,363,716 | B1 * | 4/2002 | Balko et al. | 60/286 |
| 6,843,054 | B2 * | 1/2005 | Taylor et al. | 60/275 |
| 6,881,386 | B2 * | 4/2005 | Rabinovich et al. | 422/186.04 |
| 6,959,542 | B2 * | 11/2005 | Taylor et al. | 60/295 |
| 6,976,353 | B2 * | 12/2005 | Daniel et al. | 60/275 |
| 7,029,636 | B2 * | 4/2006 | Ricatto et al. | 422/186.04 |
| 7,063,819 | B2 * | 6/2006 | Rosocha | 422/186.04 |
| 2003/0031610 | A1 * | 2/2003 | Ricatto et al. | 422/186.04 |
| 2003/0200742 | A1 * | 10/2003 | Smaling | 60/275 |
| 2003/0221414 | A1 * | 12/2003 | Kim et al. | 60/275 |
| 2004/0020191 | A1 * | 2/2004 | Kramer | 60/286 |
| 2004/0093853 | A1 * | 5/2004 | Hemingway et al. | 60/275 |
| 2005/0039441 | A1 * | 2/2005 | Kakinohana et al. | 60/275 |
| 2005/0126159 | A1 * | 6/2005 | Cho et al. | 60/275 |

FOREIGN PATENT DOCUMENTS

| | | | |
|---|---|---|---|
| JP | 2002-276333 | | 9/2002 |
| JP | 2003 286819 | | 10/2003 |
| JP | 2004 346828 | | 12/2004 |
| JP | 2004-353596 | | 12/2004 |
| JP | 2006-161768 | | 6/2006 |
| KR | 2002 0017511 | | 3/2002 |
| KR | 10 0522168 | | 10/2005 |
| KR | 10-2005-0111486 | * | 3/2006 |
| KR | 10 0638639 | | 10/2006 |
| WO | WO 01/92694 A1 | | 12/2001 |

OTHER PUBLICATIONS

English translation of KR 10-2005-0111486.*

Extended Search Report issued Feb. 23, 2011 in Europe Application No. 07768725.9.

* cited by examiner

【FIG. 1】
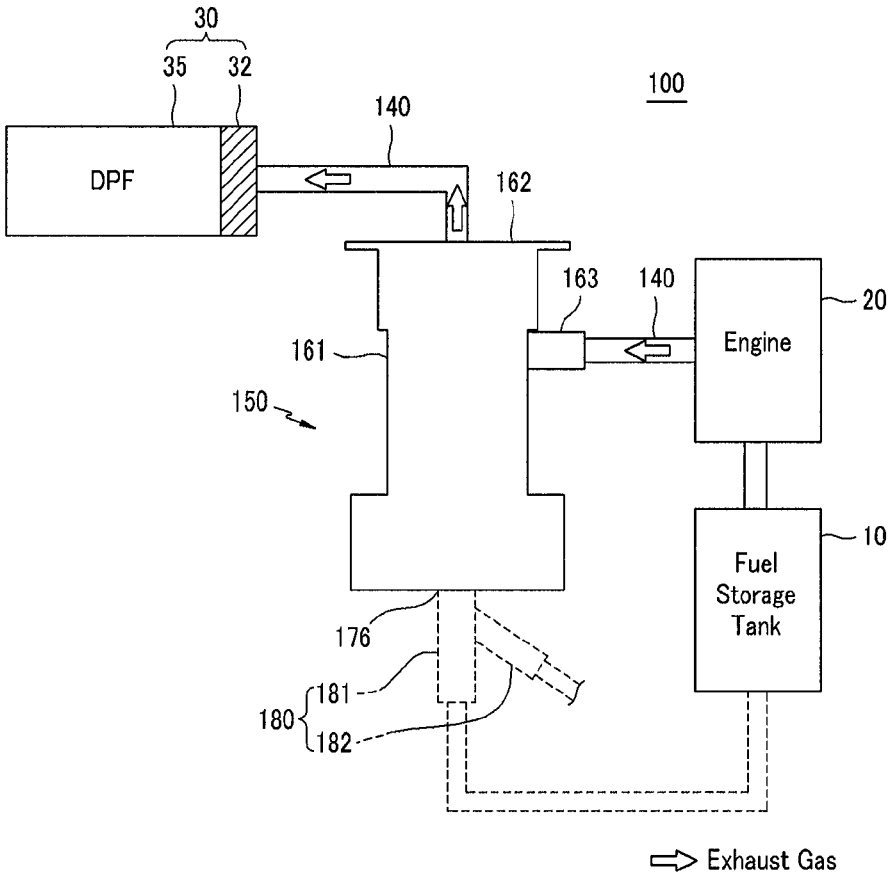

【FIG. 2】
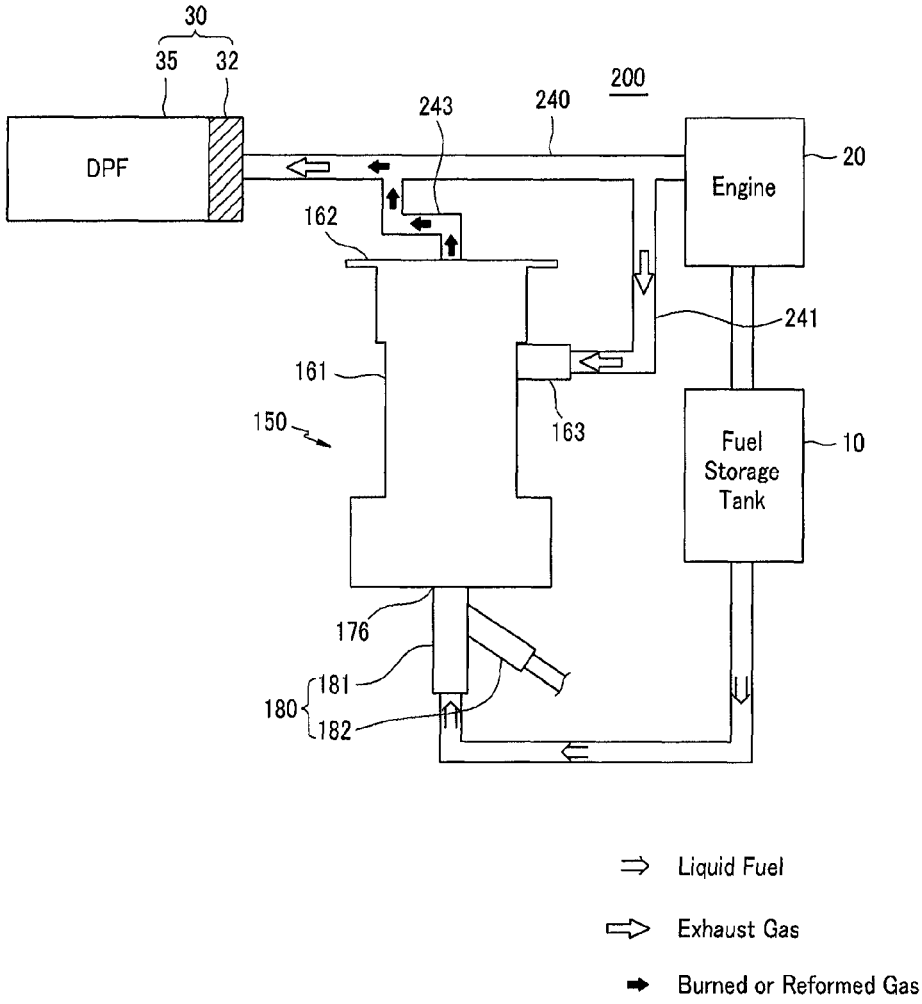

【FIG. 3】
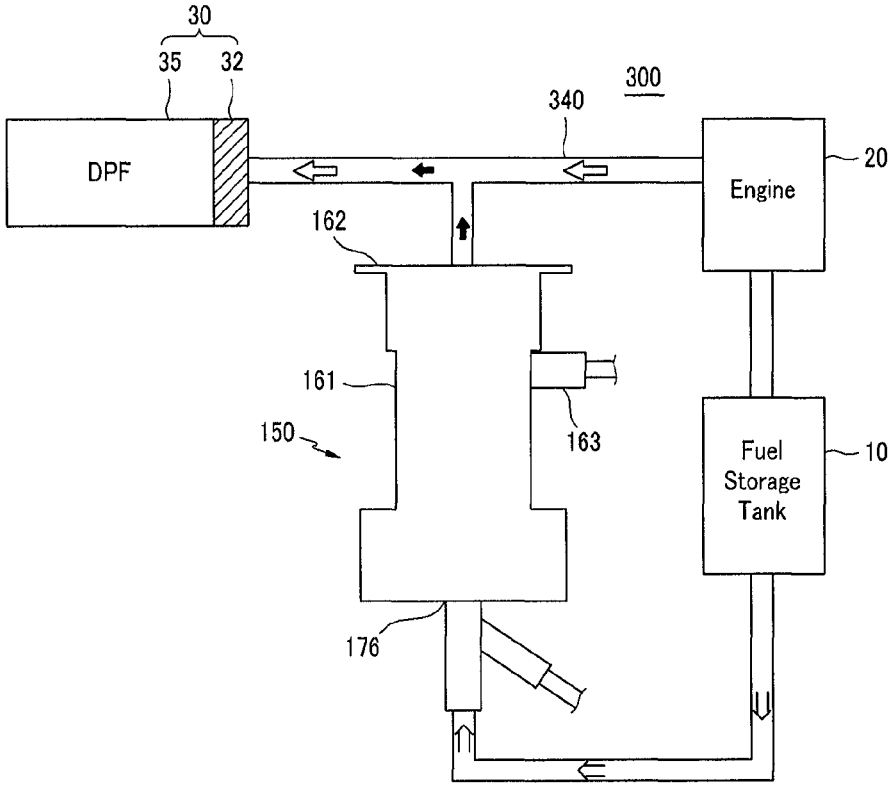

【FIG. 4】
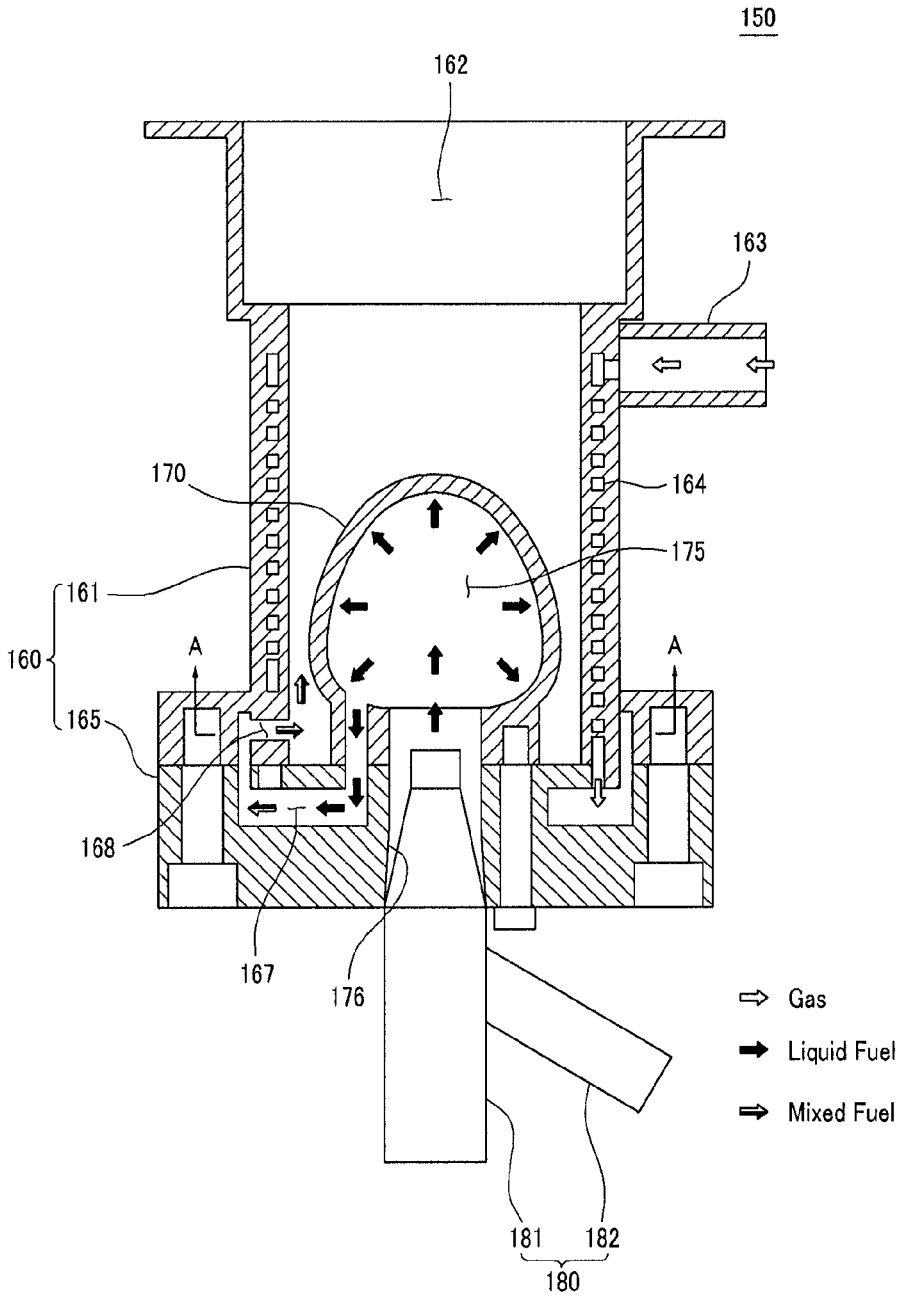

【FIG. 5】
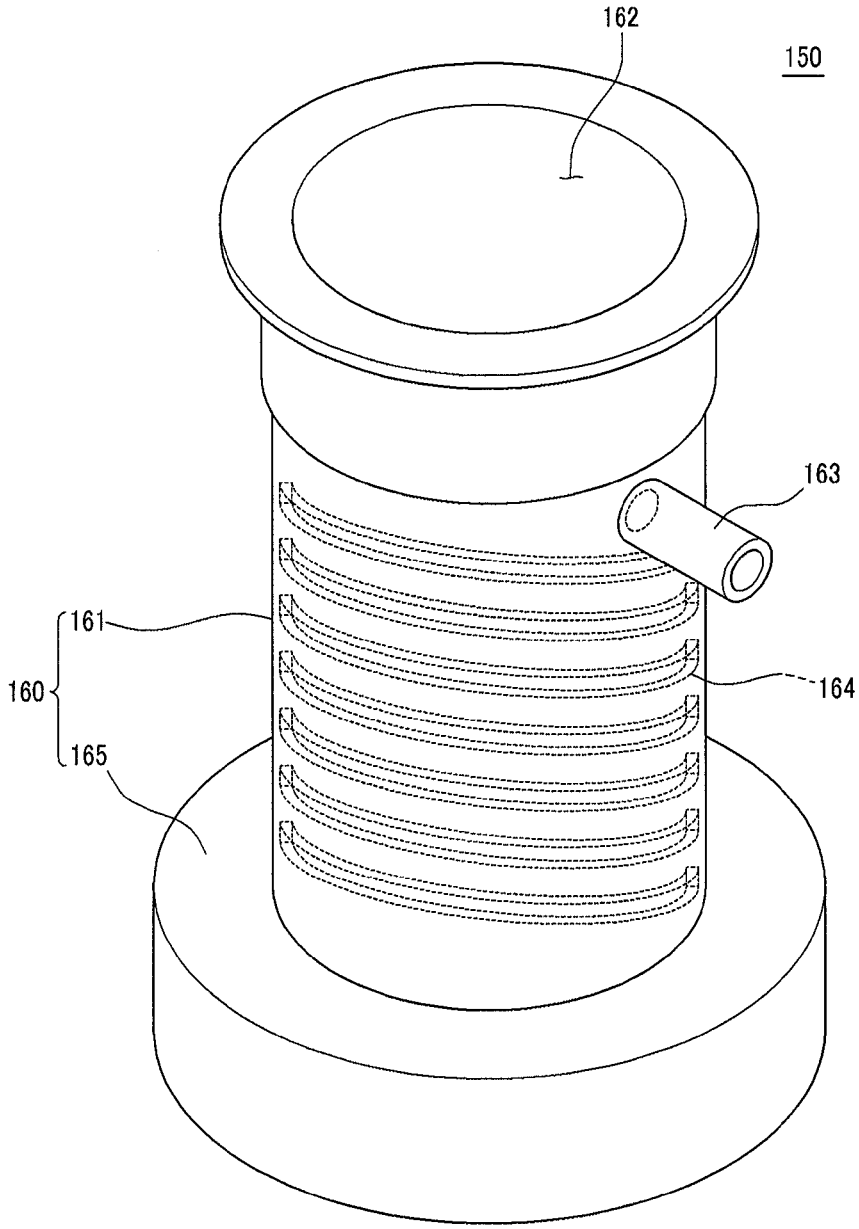

【FIG. 6】
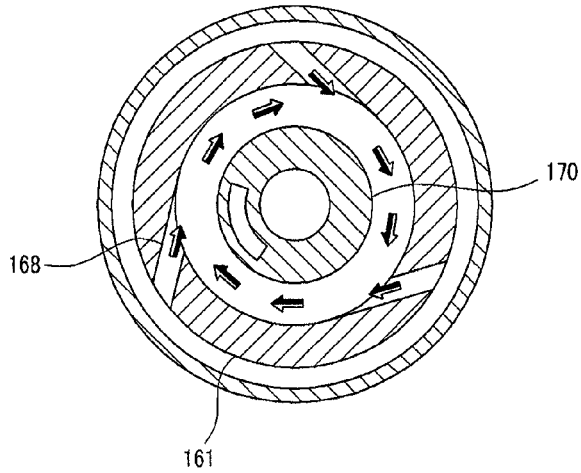
【FIG. 7】
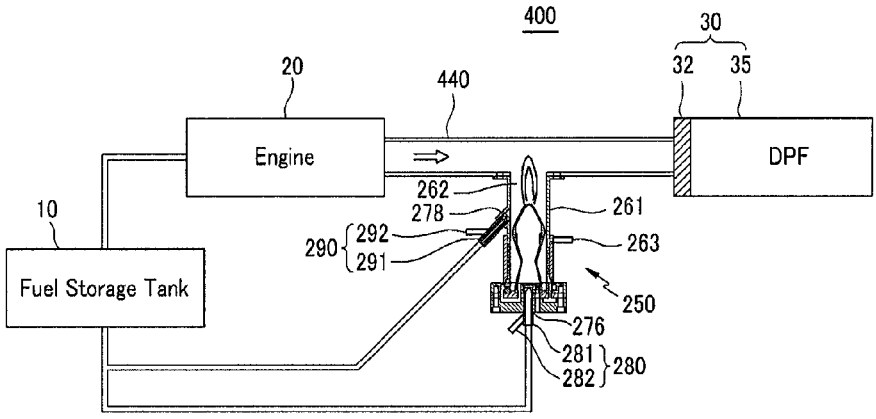

【FIG. 8】
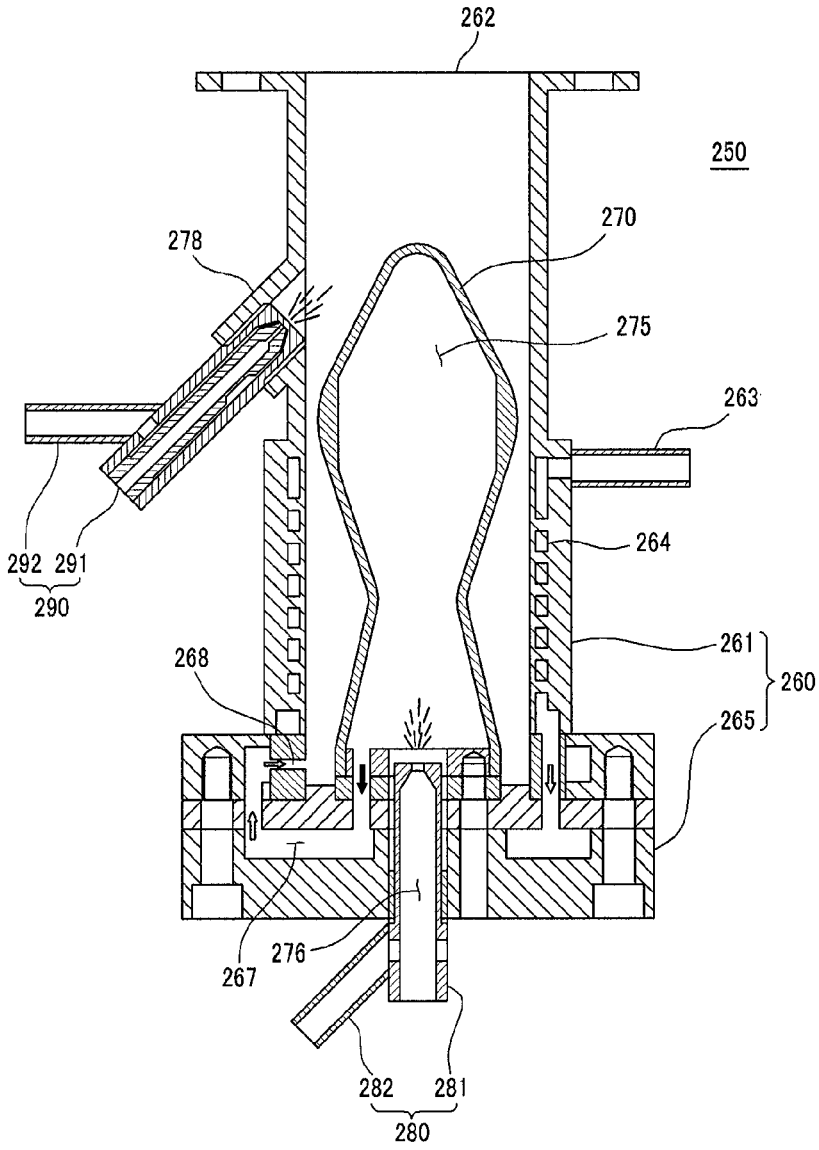

【FIG. 9】
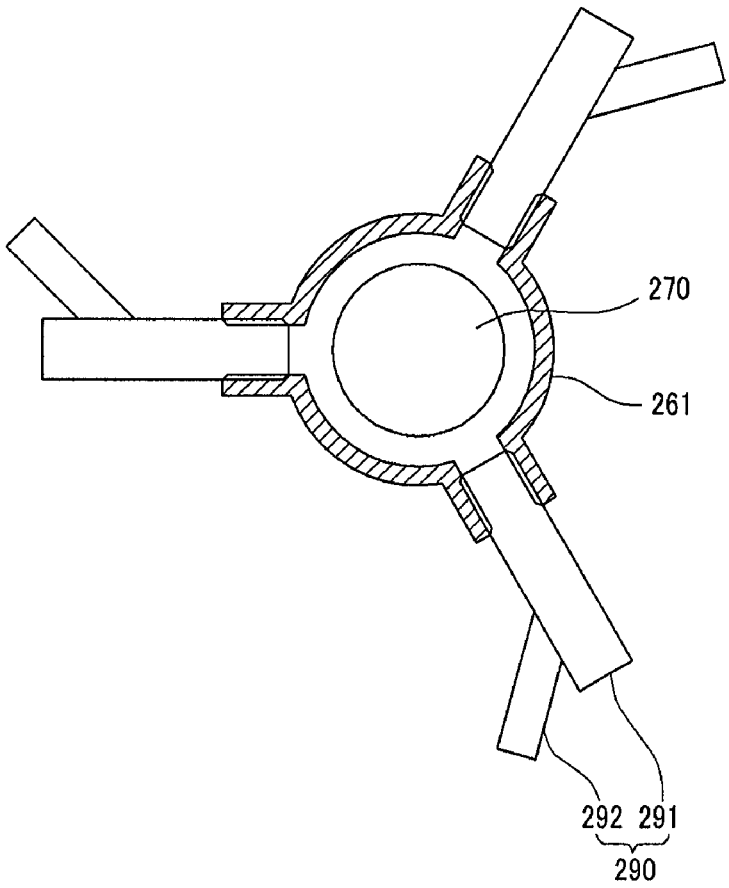

【FIG. 10】
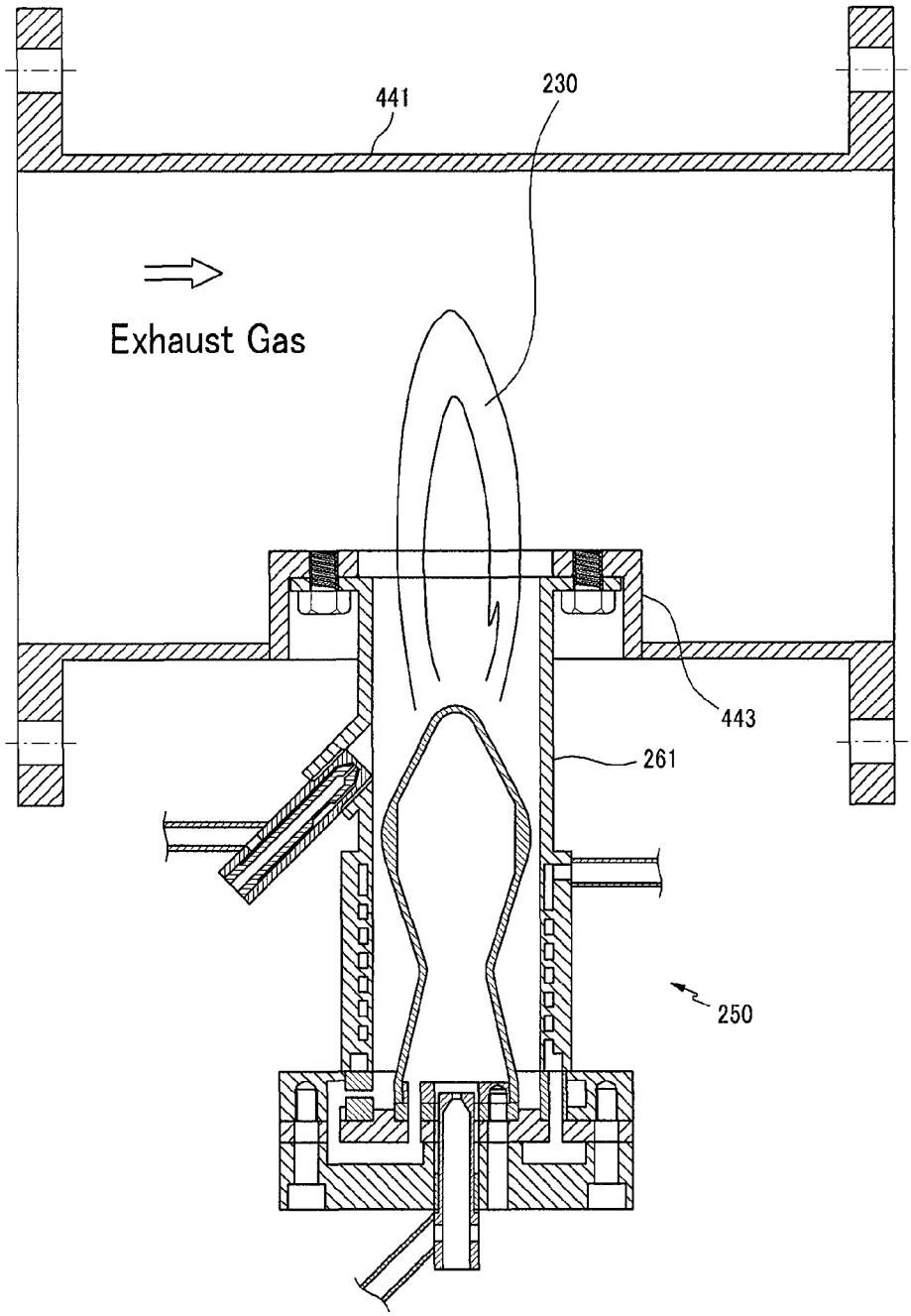

【FIG. 11】
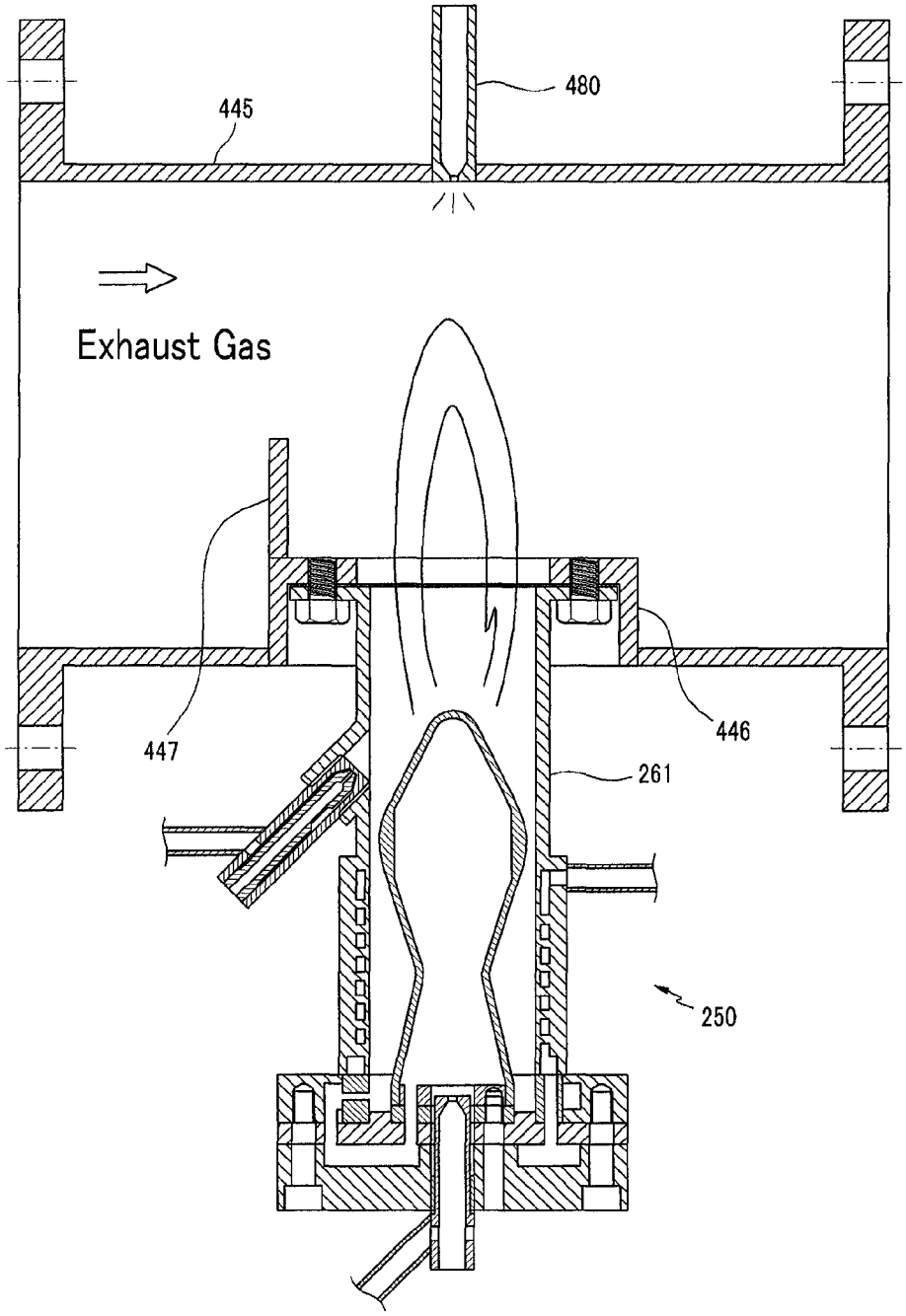

【FIG. 12】
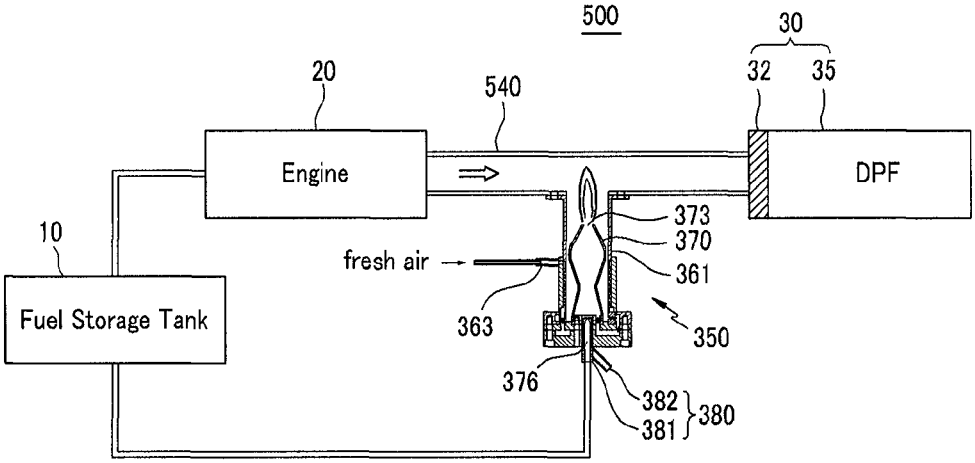

【FIG. 13】
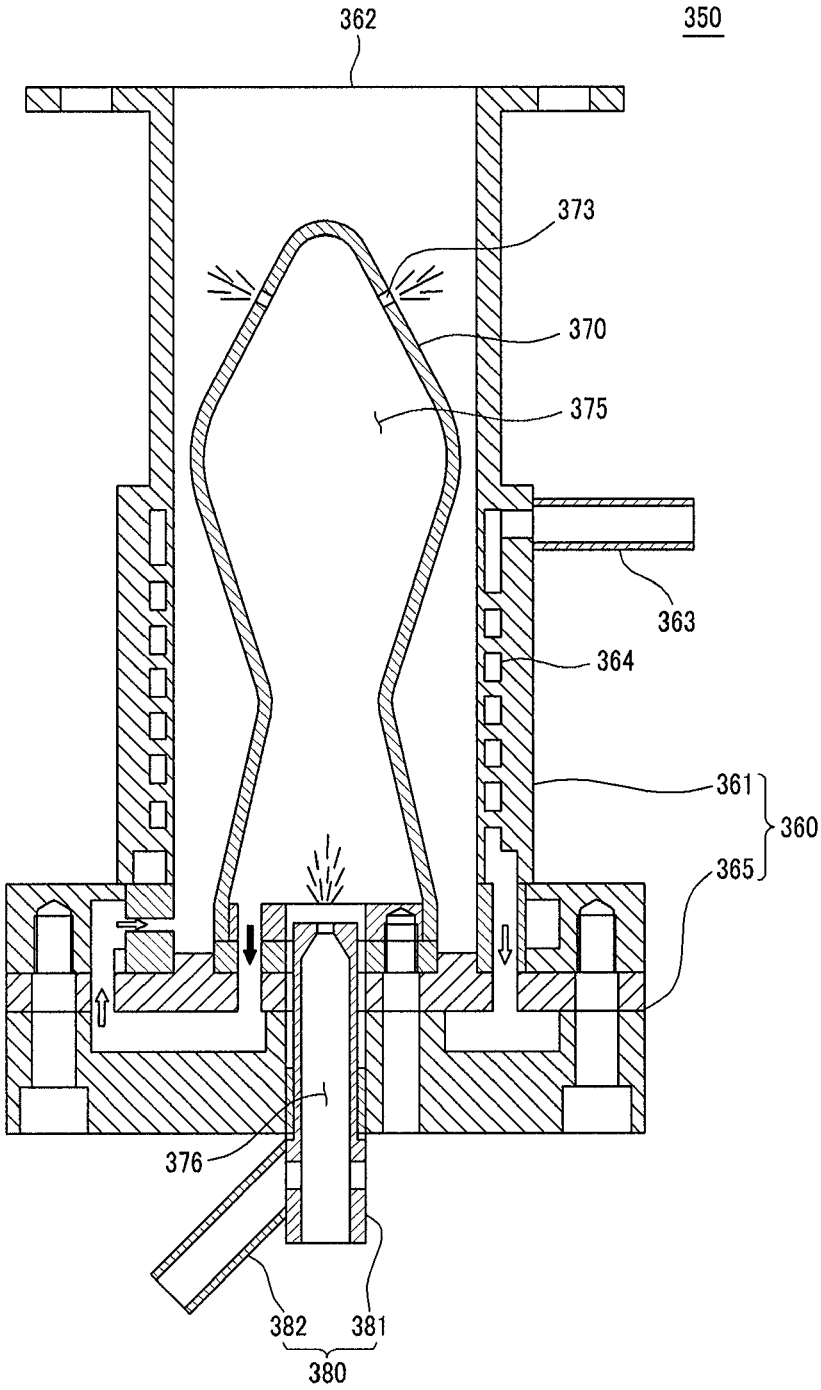

【FIG. 14】
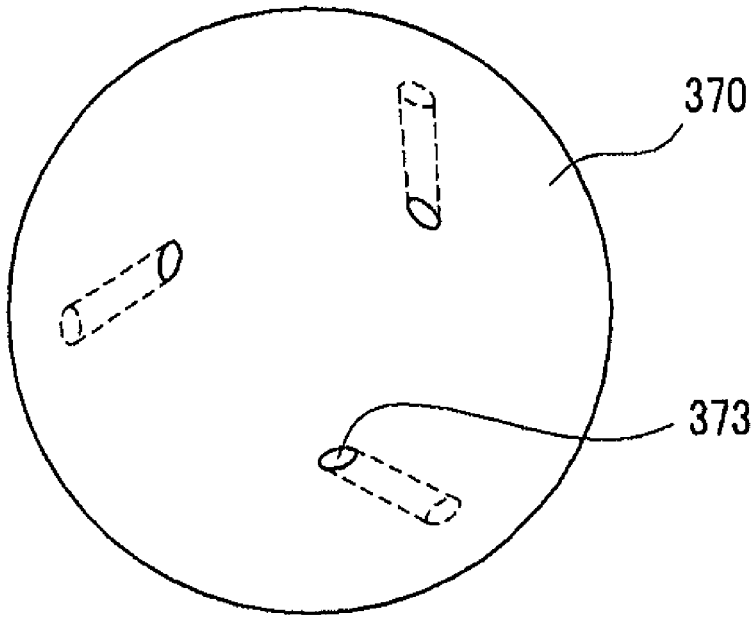

【FIG. 15】
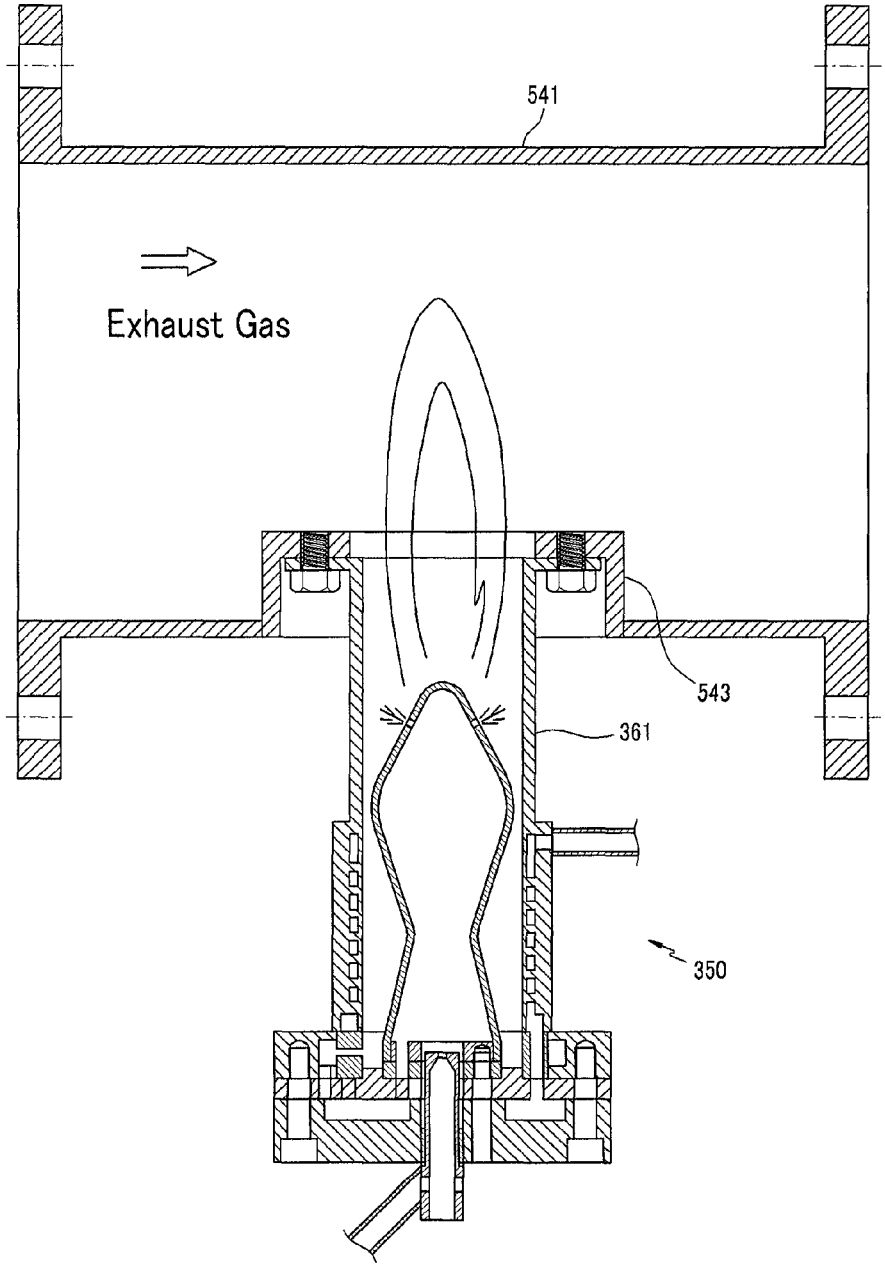

【FIG. 16】
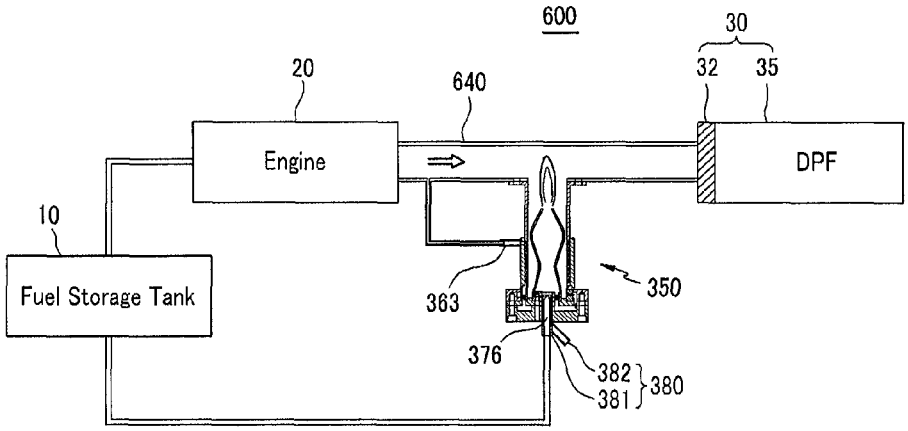

【FIG. 17】
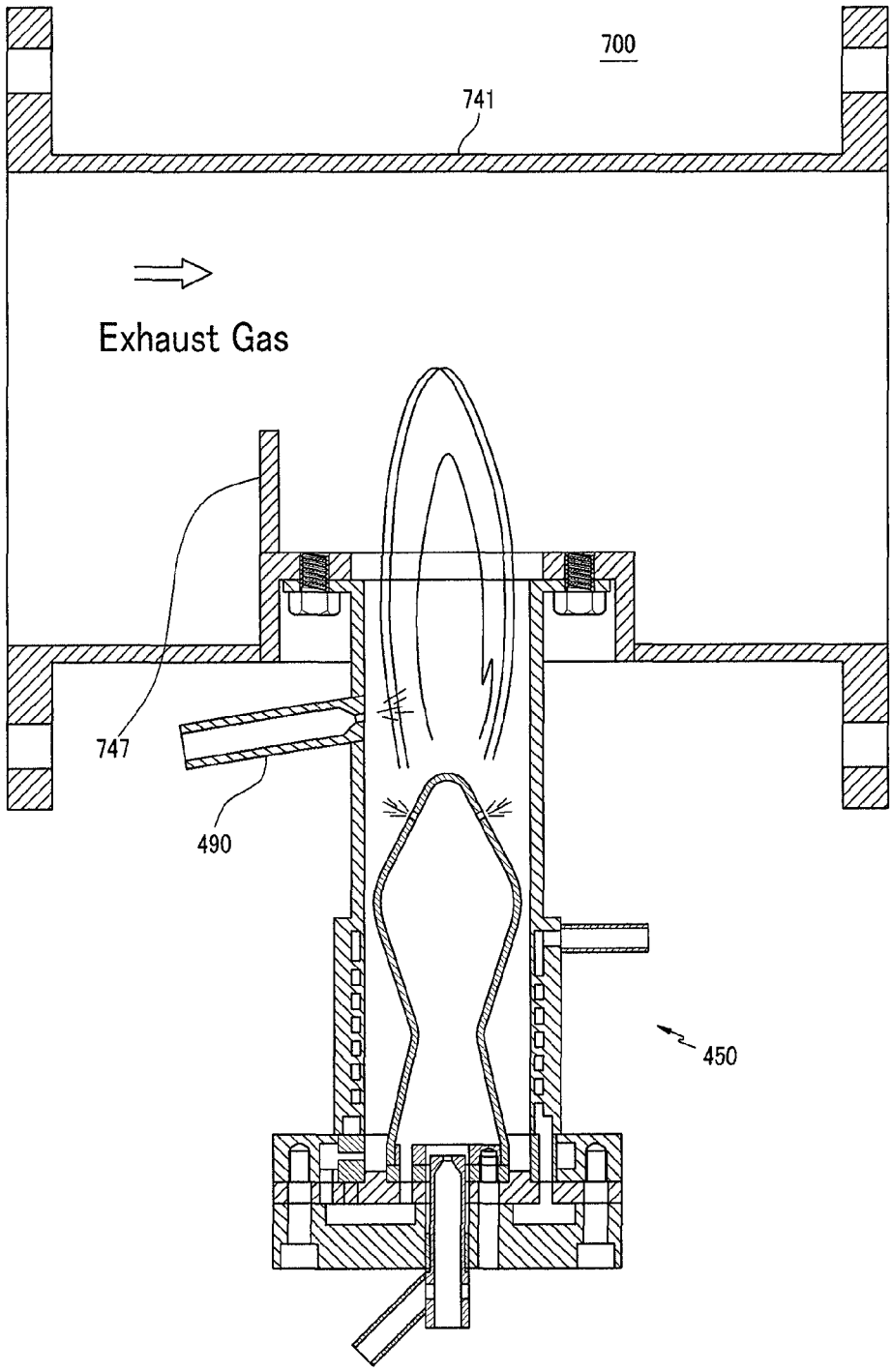

APPARATUS FOR PLASMA REACTION AND SYSTEM FOR REDUCTION OF PARTICULATE MATERIALS IN EXHAUST GAS USING THE SAME

TECHNICAL FIELD

The present invention relates to an exhaust gas after-treatment system of a vehicle, and more particularly relates to a plasma reactor and a reduction system for particulate materials within exhaust gas, in which the reactor and the system may serve to oxidize and effectively remove the particulate materials by heating the exhaust gas before a filter in a diesel particulate filter (DPF) trap for removing particulate materials of exhaust gas exhausted from an engine.

BACKGROUND ART

An apparatus and a method for regenerating a particulate filter of an exhaust system of an internal combustion engine is known, for example, from US 2003/0200742.

Particulate materials (PM) within exhaust gas of a vehicle are mainly exhausted from diesel engines that generally control power output by a mixing ratio of air and fuel. Diesel engines increase fuel supply with respect to a quantity of air and burn the fuel when instantaneous high power is needed. When this occurs, a large amount of vehicle exhaust pollutants may be generated by incomplete combustion of the fuel due to a shortage of air. Further, during combustion in a diesel engine, a locally dense amount of PM may appear since the time of spraying fuel into a combustion chamber is extremely quick compared to a resultant increase in intake air quantity, and thus a large amount of vehicle exhaust pollutants may be generated. Generally, PM has a minute diameter and includes a large amount of soluble organic materials in addition to carbon particles. Research into human body hazards is currently proceeding based upon recent reports of this being a factor of lung cancer.

DPF traps use a technology of collecting and burning PM that is exhausted from diesel engines, and can reduce PM by more than 80%. However, the technology has drawbacks of high cost and uncertainty of durability. Technology of DPF traps is mainly classified as collecting PM, and regenerating and controlling technology.

DPF trap methods are classified as active regeneration methods and passive regeneration methods according to the method of burning PM during a regeneration process. The active regeneration method actively applies heat for regeneration using an electric heater, a burner, or a throttle, and the passive regeneration method regenerates a filter with additives or oxidation catalysts using the heat of the exhaust gas. Since a vehicle that is primarily city driven emits exhaust gas of a low temperature, and thus cannot obtain desired performance with only a passive regeneration method, a combination method using both active regeneration and passive regeneration is currently generally adopted.

The DPF technology of the passive regeneration method lowers the passive regeneration temperature of PM from 650° C. to 300° C. using catalysts or additives. However, the passive regeneration method is difficult to apply directly to city buses since city buses run at a low speed and stop often, and thus the temperature of the exhaust gas is low or usually below 250° C. The method is also difficult to apply to mid-size or small diesel vehicles of which the temperature of the exhaust gas is low in the range of from 150° C. to 200° C.

When the active regeneration method is applied using an electric heater, the cost of required electric power becomes excessively high. When the active regeneration method is applied using a burner that has a simple structure, it is difficult to control the operation according to the condition of oxygen within the exhaust gas, which varies depending on operating conditions since the burner uses oxygen within the exhaust gas. The method of throttling or injecting fuel additives lowers the oxidation temperature of PM at the catalyst, but the method needs a device for throttling on the intake/exhaust pipe and has a possibility of secondary contamination by the additives.

DISCLOSURE

Technical Problem

The present invention provides a particulate material reduction system in which a promptly operating plasma reactor applies heat to exhaust gas proceeding toward a filter of a DPF trap for removing particulate materials in exhaust gas from an engine, and thereby the filter may oxidize and remove the collected particulate materials promptly and effectively.

The present invention also provides a particulate material reduction system in which liquid fuel supplied from a fuel storage tank is transferred to a filter section after being reformed to pre-oxidation materials that can be oxidized at the filter in advance by a plasma reactor, and thereby causing good conditions for oxidation of the collected particulate materials, such that the oxidation of the particulate materials can be facilitated effectively.

The present invention also provides a particulate material reduction system in which a structure of a plasma reactor is reformed to improve the mixibility of gas and liquid supplied, and thereby operational reliability of the overall system is ensured.

The present invention also provides a particulate material reduction system in which a plasma reactor stably guides a flame created by liquid fuel that is sprayed and supplied into the plasma reactor and heats up exhaust gas, and thereby the heated exhaust gas is supplied to a filter such that oxidation catalysts of the filter may oxidize and burn accumulated particulate materials and may cause good conditions for regeneration of the filter.

The present invention also provides a particulate material reduction system in which liquid fuel is sprayed and supplied to a flame formed from a plasma reactor, and thereby evaporated fuel is immediately and continually supplied to a filter such that oxidation catalysts of the filter may oxidize and heat the evaporated fuel and may cause good conditions for regeneration of particulate materials.

Technical Solution

According to an exemplary embodiment of the present invention, a reduction system for particulate materials in exhaust gas, which is connected to a tailpipe of an engine that burns a hydrocarbon-based fuel supplied from a fuel storage tank, and collects and removes particulate materials within the exhaust gas, may include a plasma reactor having a gas inlet and an outlet, and a DPF (diesel particulate filter) trap having a filter.

The tailpipe of the engine may communicate with the gas inlet of the plasma reactor, and the outlet of the plasma reactor may communicate with the DPF trap. The exhaust gas exhausted from the engine may be transferred to the DPF trap after being heated while passing through the plasma reactor.

The plasma reactor may include a body including a reaction chamber having the gas inlet and the outlet and a base formed at the lower end of the reaction chamber, the base including a mixing chamber communicating with the gas inlet and communicating with the reaction chamber via an inflow hole, and an electrode protruding inside the reaction chamber while being supported by the base and being spaced apart from the inner surface of the reaction chamber.

A fuel inlet may be formed on the base of the body and a heating chamber may be formed inside the electrode, the heating chamber communicating with the mixing chamber and the fuel inlet being connected to the heating chamber. A fuel injector may be provided to the fuel inlet, the fuel injector being fixed on the base of the body.

A heat exchanging conduit may be formed in a wall body of the reaction chamber to communicate the gas inlet with the mixing chamber, the heat exchanging conduit being spiral in form along a circumference of the reaction chamber.

The inflow hole may be formed on the inner surface of the reaction chamber to skew off at an angle to a normal line of the inner surface of the reaction chamber, wherein mixed fuel formed by mixing gas and fuel in the mixing chamber flows into the reaction chamber through the inflow hole while forming a rotational flow and circulates around a circumference of the electrode.

According to another exemplary embodiment of the present invention, the tailpipe of the engine may be branched off and communicated with the DPF trap and the inlet for gas of the plasma reactor, respectively, and the outlet of the plasma reactor may be communicated with the tailpipe that connects the engine and the DPF trap. A part of the exhaust gas exhausted from the engine may be transferred to the DPF trap after being heated while passing through the plasma reactor.

The plasma reactor may have a fuel inlet and the fuel inlet may be connected to the fuel storage tank. Fuel injected through the fuel inlet may be plasma-reacted in the reaction chamber together with the exhaust gas flowing in through the gas inlet, such that the fuel may be reformed to a pre-oxidation material that may be oxidized at a relatively low temperature in comparison with the exhaust gas, or burned to raise the temperature of the exhaust gas, and may be transferred to the DPF trap. The pre-oxidation material may include hydrogen or carbon monoxide.

A fuel supply conduit fixed to the base of the body may be fitted to the fuel inlet, and a gas supply conduit may be fitted to a side of the fuel supply conduit to communicate therewith, thereby spraying the fuel supplied through the fuel supply conduit into the heating chamber with the gas supplied through the gas supply conduit.

According to yet another exemplary embodiment of the present invention, the tailpipe of the engine may communicate with the DPF trap, and the outlet of the plasma reactor may communicate with the tailpipe that connects the engine and the DPF trap.

The plasma reactor may have a fuel inlet and the fuel inlet may be connected to the fuel storage tank. Fuel injected through the fuel inlet may be plasma-reacted in the reaction chamber, such that the fuel may be reformed to a pre-oxidation material that may be oxidized at a relatively low temperature in comparison with the exhaust gas, or burned to raise the temperature of the exhaust gas, and is transferred to the DPF trap.

According to yet another exemplary embodiment of the present invention, the tailpipe of the engine may communicate with the DPF trap, and the outlet of the plasma reactor may communicate with the tailpipe that connects the engine and the DPF trap. The plasma reactor may include a first fuel injector being fitted to a first fuel inlet formed on the base of the body and spraying liquid fuel into the mixing chamber, and a second fuel injector being fitted to a second fuel inlet connected to the reaction chamber and spraying liquid fuel into the reaction chamber.

A heating chamber may be formed inside the electrode, the heating chamber communicating with the mixing chamber and the first fuel inlet being connected to the heating chamber, such that the first fuel injector may spray liquid fuel into the heating chamber. The second fuel injector may be fitted to skew off at an angle to the inner surface of the reaction chamber on the side thereof, and may spray and supply liquid fuel above the electrode inside the reaction chamber. The first fuel injector and the second fuel injector may be connected to the fuel storage tank.

A protection plate may be provided adjacent to the outlet of the plasma reactor in the tailpipe to block a crosswind of the exhaust gas. The protection plate may be located upstream of the exhaust gas flow, before the outlet of the plasma reactor.

The reduction system may further include a third fuel injector fitted to a third fuel inlet formed on the tailpipe at a position corresponding to the plasma reactor.

According to yet another exemplary embodiment of the present invention, the tailpipe of the engine may communicate with the DPF trap, and the outlet of the plasma reactor may communicate with the tailpipe that connects the engine and the DPF trap. The plasma reactor may include a fuel injector fitted to a fuel inlet that may be connected to the heating chamber of the electrode, the fuel injector spraying and supplying liquid fuel into the heating chamber. The electrode may include a spray nozzle through which the inside of the reaction chamber may communicate with the heating chamber.

The spray nozzle of the electrode may be formed to skew off at an angle to an exterior surface of the electrode.

Advantageous Effects

According to first to third exemplary embodiments of the present invention, a promptly operating plasma reactor applies heat to exhaust gas proceeding toward a filter of a DPF trap for removing particulate materials in exhaust gas from an engine, and thereby the filter can oxidize and remove the collected particulate materials promptly and effectively.

Further, according to the first to third exemplary embodiments of the present invention, liquid fuel supplied from a fuel storage tank is transferred to a DPF trap after being reformed to pre-oxidation materials mainly composed of hydrogen and carbon monoxide, which can be oxidized at the DPF trap in advance or burned by a plasma reactor, and thereby developing beneficial conditions for oxidation of the collected particulate materials such that the oxidation of the particulate materials can be facilitated effectively.

Further, according to the first to third exemplary embodiments of the present invention, the plasma reactor has a reformed structure to improve the mixibility of supplied gas and liquid, and thereby the operational reliability of the overall system can be ensured.

According to a fourth exemplary embodiment of the present invention, although there is a composition and temperature variation of the exhaust gas depending on operational conditions, a flame created by liquid fuel sprayed into the plasma reactor can be stably maintained, and thereby there is no variation of performance under load and dependence of the performance of the plasma burner according to the load condition is drastically reduced, and further the equipment of the device and the operational condition can be simplified.

Further, the plasma reactor can stably maintain evaporation performance regardless of a compositional condition of the gas and the fuel, and thus it can increase the limits beyond the conventional method using a burner.

The plasma reactor of the present invention is particularly outstanding in atomization characteristics of liquid fuel, evaporation characteristics, and mixing characteristics with an oxidizing agent such that it can advance the technology of reduction of particulate materials.

According to fifth to seventh exemplary embodiments of the present invention, the plasma reactor can be simplified by forming a spraying nozzle on an electrode to spray fuel, and the plasma reactor enables the fuel to be evaporated directly at the electrode and transferred to a mixing chamber, and thereby a large amount of flowing fuel can be evaporated and thoroughly burned.

Because of the reduction system, noxious materials such as unburned hydrocarbons that are normally exhausted while cold starting without treatment due to low temperature can be removed, and the previously equipped after-treatment device can operate successfully even in a low-temperature condition such as city driving.

As a result, by the above-mentioned effects, the particulate materials within the exhaust gas, which are a factor of environmental pollution, can be removed effectively, and thus the ultimate goal of environmental pollution alleviation can be accomplished.

DESCRIPTION OF DRAWINGS

FIG. 1 is a schematic diagram of a particulate material reduction system according to a first exemplary embodiment of the present invention.

FIG. 2 is a schematic diagram of a particulate material reduction system according to a second exemplary embodiment of the present invention.

FIG. 3 is a schematic diagram of a particulate material reduction system according to a third exemplary embodiment of the present invention.

FIG. 4 is a cross-sectional view of a plasma reactor applied to the first through third exemplary embodiments of the present invention.

FIG. 5 is a perspective view of the plasma reactor applied to the first through third exemplary embodiments of the present invention, which illustrates the shape of a heat exchanging conduit.

FIG. 6 is a cross-sectional view taken along an A-A line of FIG. 4, which illustrates the shape of an inflow hole.

FIG. 7 is a schematic diagram of a particulate material reduction system according to a fourth exemplary embodiment of the present invention.

FIG. 8 is a cross-sectional view of a plasma reactor applied to the fourth exemplary embodiment of the present invention.

FIG. 9 is a partial cross-sectional view illustrates the plasma reactor shown in FIG. 8 having a second fuel injector.

FIG. 10 is a cross-sectional view of the particulate material reduction system according to the fourth exemplary embodiment of the present invention, which illustrates a type of plasma reactor connected to a connection tailpipe.

FIG. 11 is a cross-sectional view of the particulate material reduction system according to the fourth exemplary embodiment of the present invention, which illustrates another type of plasma reactor connected to a connection tailpipe, with a protection plate formed therein.

FIG. 12 is a schematic diagram of a particulate material reduction system according to a fifth exemplary embodiment of the present invention.

FIG. 13 is a schematic diagram of a particulate material reduction system according to a sixth exemplary embodiment of the present invention.

FIG. 14 is a plan view of the electrode of the plasma reactor shown in FIG. 13, which illustrates the position and shape of spraying nozzles.

FIG. 15 is a cross-sectional view of the particulate material reduction system according to the fifth exemplary embodiment of the present invention, which illustrates a type of plasma reactor connected to a connection tailpipe.

FIG. 16 is a schematic diagram of a particulate material reduction system according to a sixth exemplary embodiment of the present invention.

FIG. 17 is a cross-sectional view of the particulate material reduction system according to a seventh exemplary embodiment of the present invention, which illustrates a type of plasma reactor connected to a connection tailpipe, with a protection plate formed therein.

BEST MODE

Hereinafter, the present invention will be described more fully with reference to the accompanying drawings, in which exemplary embodiments of the invention are shown. The invention may, however, be embodied in different forms and should not be construed as limited to the embodiments set forth herein. To clearly describe embodiments of the present invention, parts not related to the description are omitted, and like reference numerals designate like elements throughout the specification.

FIG. 1 is a schematic diagram of a particulate material reduction system according to a first exemplary embodiment of the present invention.

As shown in FIG. 1, a particulate material reduction system 100 according to the present embodiment includes a diesel particulate filter (DPF) trap that is connected to a tailpipe 140 of an engine 20 that burns a hydrocarbon-based fuel supplied from a fuel storage tank 10, and collects and removes particulate materials within exhaust gas, such that the reduction system constitutes an exhaust gas after-treatment system. Further, the particulate material reduction system 100 includes a plasma reactor 150 having a gas inlet 163 and an outlet 162, and the DPF trap 30 includes an oxidation catalyst 32 and a filter 35. The present embodiment illustrates the DPF trap 30 having the oxidation catalyst 32 as an example, but the particulate material reduction system of the present invention may be realized without an oxidation catalyst and may still expect the effects pursued by the present invention. The following applies to all exemplary embodiments below.

The tailpipe 140 of the engine 20 is connected to the gas inlet 163 of the plasma reactor 150, and the outlet 162 of the plasma reactor 150 is connected to the DPF trap 30. Exhaust gas exhausted from the engine 20 is transferred to the DPF trap 30 after being heated while passing through the plasma reactor 150.

The caliber of the outlet 162 of the plasma reactor 150 may be formed to be the same or close to that of the tailpipe 140, but in FIG. 1 the caliber of the outlet 162 is illustrated to be larger than that of the tailpipe 140 for convenience of explanation. This also applies to the other drawings below.

In the present embodiment, the plasma reactor 150 is provided in a route of the exhaust gas as it is transferred from the engine 20 to the DPF trap 30. The plasma reactor 150 reacts plasma with the supplied exhaust gas and exhausts the resultant toward the DPF trap 30 section, and the exhaust gas that is transferred to the DPF trap 30 is heated by the plasma reaction. Accordingly, a condition of a high temperature for oxidation may be maintained when the exhaust gas is oxidized at the oxidation catalyst 32 of the DPF trap 30.

In the present embodiment, the entire quantity of the exhaust gas transferred from the engine 20 to the DPF trap 30 through the tailpipe 140 is passed through the plasma reactor 150. Further, the plasma reactor 150 may further include a fuel inlet 176 connected to the fuel storage tank 10, through which a liquid fuel may be supplied into the plasma reactor 150. The fuel injected through the fuel inlet 176 is plasma-reacted in the reaction chamber 161 with the exhaust gas having flowed through the gas inlet 163 and is partly reformed to pre-oxidation materials, which may be oxidized at a relatively low temperature in comparison with the exhaust gas, or burned, and is then transferred to the DPF trap 30.

FIG. 2 is a schematic diagram of a particulate material reduction system according to a second exemplary embodiment of the present invention.

As shown in FIG. 2, a particulate material reduction system 200 according to the present embodiment includes a DPF trap that is connected to a tailpipe 240 of an engine 20 that burns a hydrocarbon-based fuel supplied from a fuel storage tank 10, and collects and removes particulate materials within exhaust gas, such that the reduction system constitutes an exhaust gas after-treatment system. Further, the particulate material reduction system 200 includes a plasma reactor 150 having a gas inlet 163 and an outlet 162, and a DPF trap 30 having an oxidation catalyst 32 and a filter 35.

The tailpipe 240 of the engine 20 is connected to the DPF trap 30, a first branch line 241 branched from the tailpipe 240 is connected to the gas inlet 163 of the plasma reactor 150, and the outlet 162 of the plasma reactor 150 is connected to the tailpipe 240 connecting the engine 20 and the DPF trap 30 via a second branch line 243. A part of the exhaust gas exhausted from the engine 20 is transferred to the DPF trap 30 after being heated while passing through the reaction chamber 161 of the plasma reactor 150.

The plasma reactor 150 includes a fuel inlet 176, and the fuel inlet 176 is connected to the fuel storage tank 10. The fuel injected through the fuel inlet 176 is plasma-reacted in the reaction chamber 161 with the exhaust gas having flowed through the gas inlet 163 and is partly reformed to pre-oxidation materials, which may be oxidized at a relatively low temperature in comparison with the exhaust gas, or burned, and is then transferred to the DPF trap 30.

In the present embodiment, the plasma reactor 150 is provided in a route of the exhaust gas as it is transferred from the engine 20 to the DPF trap 30. The plasma reactor 150 may be supplied with a part of the exhaust gas and with hydrocarbon-based fuel from the fuel storage tank 10 at the same time. Accordingly, the exhaust gas supplied to the plasma reactor 150 is heated by the plasma reaction, and the fuel supplied together with the exhaust gas is partly reformed to pre-oxidation materials while being plasma-reacted with oxygen ($O_2$) within the exhaust gas. Such pre-oxidation materials may contribute to an increased temperature by oxidation and heat emission at a relatively low temperature at the oxidation catalyst, where the pre-oxidation materials may be obtained by reforming the hydrocarbon-based fuel supplied to the plasma reactor 150 and the oxygen within the exhaust gas. Examples of pre-oxidation materials are hydrogen ($H_2$) and carbon monoxide (CO), and a composition ratio of these materials can be controlled by changing a mixing ratio of air and fuel.

The pre-oxidation materials created as in the above are transferred to the DPF trap 30, and then supplies heat to the section of the oxidation catalyst 32 of the DPF trap 30 by oxidation.

In other words, in the present embodiment, a part of the exhaust gas is used to burn fuel by plasma discharge while passing through the plasma reactor 150 or transferred to the DPF trap 30 while maintaining such state to heat the oxidation catalyst 32 section. At the same time, pre-oxidation materials, which are created by reforming the hydrocarbon-based fuel supplied to the plasma reactor 150 with the oxygen within the exhaust gas, are transferred to the DPF trap 30 and are oxidized at the oxidation catalyst 32 in advance. Accordingly, the filter 35 can be regenerated by burning and removing the particulate materials collected in the filter 35 while heating the oxidation catalyst 32 section at an appropriate temperature for oxidation of the particulate materials.

FIG. 3 is a schematic diagram of a particulate material reduction system according to a third exemplary embodiment of the present invention.

As shown in FIG. 3, a particulate material reduction system 300 according to the present embodiment includes a DPF trap that is connected to a tailpipe 340 of an engine 20 that burns a hydrocarbon-based fuel supplied from a fuel storage tank 10, and collects and removes particulate materials within exhaust gas, such that the reduction system constitutes an exhaust gas after-treatment system. Further, the particulate material reduction system 300 includes a plasma reactor 150 having a gas inlet 163 and an outlet 162, and a DPF trap 30 having an oxidation catalyst 32 and a filter 35.

The tailpipe 340 of the engine 20 is connected to the DPF trap 30, and the outlet 162 of the plasma reactor 150 is connected to the tailpipe 340 that connects the engine 20 and the DPF trap 30. The plasma reactor 150 includes a fuel inlet 176, and the fuel inlet 176 is connected to the fuel storage tank 10.

Hence, the fuel injected through the fuel inlet 176 is plasma-reacted in the reaction chamber 161 and is reformed to pre-oxidation materials, which may be oxidized at a relatively low temperature in comparison with the exhaust gas, or burned, and is then transferred to the DPF trap 30.

In the present embodiment, the outlet 162 of the plasma reactor 150 is provided to a route of the exhaust gas as it is transferred from the engine 20 to the DPF trap 30. The plasma reactor 150 reforms the hydrocarbon-based fuel supplied from the fuel storage tank 10 to pre-oxidation materials that can be oxidized at a low temperature, by plasma reaction.

Oxygen or air required for reformation of the hydrocarbon-based fuel needs to be supplied to the plasma reactor 150 simultaneously, and such function can be accomplished by the gas inlet 163. Gas supplied from the outside is flowed in through the gas inlet 163, and for example, oxygen ($O_2$) or air including oxygen may be flowed in as an oxidizing agent for oxidation of the liquid fuel.

Pre-oxidation materials created through the plasma reactor 150 are transferred to the DPF trap 30 through the outlet 162 and oxidized first at the oxidation catalyst 32, and thereby the oxidation catalyst 32 section can be heated to an appropriate temperature for oxidation of the accumulated particulate materials of the exhaust gas.

The plasma reactor applied to the above exemplary embodiments needs to ensure prompt and effective mixing of the gas and liquid that flow in, and such function can be accomplished by including constitutions that will be explained in detail below.

FIG. 4 is a cross-sectional view of a plasma reactor applied to the first through third exemplary embodiments of the present invention, and FIG. 5 is a perspective view that illustrates the shape of a heat exchanging conduit.

Referring to FIG. 4, the plasma reactor 150 includes a body 160 providing a space for mixing and reaction, and an electrode 170 that applies voltage for plasma discharge. The body 160 is composed of a reaction chamber 161 and a base 165, and the electrode 170 is supported by the base 165 and protrudes inside the reaction chamber 161.

The reaction chamber 161 is formed in a cylindrical shape having an inner space therein, and a gas inlet 163 and an outlet 162 are formed thereon. The gas inlet 163 is for inflow of gases such as air or exhaust gas, and the outlet 162 is for exhaust of reacted materials after plasma reaction. The gas inlet 163 may be formed to be open toward the side of the reaction chamber 161, and the outlet 162 may be open toward a side opposite the base 165.

The base 165 is formed at the lower end of the reaction chamber 161, and includes a mixing chamber 167 communicating with the gas inlet 163 and communicating with the reaction chamber 161 through an inflow hole 168.

As shown in FIG. 5, a heat exchanging conduit 164 is formed in a wall body of the reaction chamber 161 to communicate the gas inlet 163 with the mixing chamber 167, the heat exchanging conduit 164 being spiral in form along a circumference of the reaction chamber 161. The gas flowing in through the gas inlet 163 is transferred along the heat exchanging conduit 164, and may absorb heat transferred from the reaction chamber 161.

FIG. 6 is a cross-sectional view taken along an A-A line of FIG. 4, which illustrates a shape of an inflow hole.

The inflow hole 168 is formed on the inner surface of the reaction chamber 161 to skew off at an angle to a normal line of the inner surface of the reaction chamber 161. Mixed fuel formed by mixing gas and fuel in the mixing chamber 167 flows into the reaction chamber 161 while forming a rotational flow and circulates around a circumference of the electrode 170, thereby forming a kind of swirl flow. The inflow hole 168 may be formed in plural at equal intervals, such that the inner space of the reaction chamber 161 can be utilized efficiently.

The reaction chamber 161 and the base 165 may be formed integrally, or may be assembled to each other after being manufactured separately. The base 165 may include an insulator such as ceramic to prevent electricity from flowing between the lower end of the electrode 170 and the reaction chamber 161.

The electrode 170 is supported by the base 165, and protrudes inside the reaction chamber 161 while being apart from the inner surface of the reaction chamber 161. The electrode 170 is formed in a shape of a cone, to which a high voltage is applied when operated. Here, the reaction chamber 161 is grounded to maintain a high voltage state between the electrode 170 and the reaction chamber 161.

The plasma reactor 150 may include a fuel inlet 176, and the fuel inlet 176 is connected to the fuel storage tank 10 and is supplied with liquid fuel therethrough. The fuel inlet 176 is formed on the base 165 of the body 160, and the electrode 170 has a heating chamber 175 therein. The heating chamber 175 communicating with a mixing chamber 167 may be connected to the fuel inlet 176.

A fuel injector 180 that includes a fuel supply conduit 181 and a gas supply conduit 182 in the present embodiment is fitted to the fuel inlet 176. The fuel supply conduit 181 is fixed to the base 165 of the body 160, and the gas supply conduit 182 is fitted to a side of the fuel supply conduit 181 to communicate therewith, thereby spraying the fuel supplied through the fuel supply conduit 181 into the heating chamber 175 with the gas supplied through the gas supply conduit 181. The gas supplied through the gas supply conduit 182 may be from an exterior source of supply or may be a part of the exhaust gas. A conventional injector may alternatively be applied to the fuel inlet 176 so as to spray the liquid fuel directly.

The operation of the plasma reactor 150 formed as above will be described in detail below.

The plasma reactor 150 is supplied with liquid fuel through the fuel supply conduit 181, and at the same time air or exhaust gas containing oxygen ($O_2$) flows into the plasma reactor 150 through the gas inlet 182. Here, the air or exhaust gas flowing in is transferred to the mixing chamber 167 in an activated state at which the temperature is sufficiently elevated while passing the heat exchanging conduit 164. Further, the liquid fuel that is transferred to the heating chamber 175 of the electrode 170 through the fuel supply conduit 181 is transferred again to the mixing chamber 167 in an evaporated and activated state by absorbing heat in the heating chamber 175. In the mixing chamber 167, the air or exhaust gas transferred through the heat exchanging conduit 164 is mixed with the evaporated fuel transferred from the heating chamber 175, and then the mixture flows into the inner space of the reaction chamber 161 through the inflow hole 168.

As described above, the air or the exhaust gas and the liquid fuel having flowed into the plasma reactor 150 flows into the inner space of the reaction chamber 161 after being sufficiently mixed in the mixing chamber 167. A wetting and coking phenomenon of the liquid fuel can be avoided since the liquid fuel is prevented from ejecting directly from the heating chamber 175 or prevented from directly contacting the exterior surface of the electrode 170. Further, the liquid fuel that is heated in the heating chamber 175 is immediately mixed with air in the mixing chamber 167, such that a phenomenon of liquefaction while transferring may be inherently prevented.

Meanwhile, the mixed fuel including the fuel and the air (or exhaust gas) supplied from the mixing chamber 167 into the reaction chamber 161 through the inflow hole 168 may lead to a relatively highly efficient plasma reaction based on volume according to the distinctive structure of the inflow hole 168 and the electrode 170. In accordance with the exemplary embodiments of the present invention, the electrode 170 is formed in a shape of a cone, and the inflow hole 168 is formed on the inner surface of the reaction chamber 161 to skew off at an angle to a normal line of the inner surface of the reaction chamber 161. Accordingly, the mixed fuel flowing in through the inflow hole 168 circulates along the circumference of the electrode 170 and generates a rotating arc, thereby leading to continuous plasma reaction.

FIG. 7 is a schematic diagram of a particulate material reduction system according to a fourth exemplary embodiment of the present invention, and FIG. 8 is a cross-sectional view of a plasma reactor applied to the fourth exemplary embodiment of the present invention.

As shown in FIG. 7, a particulate material reduction system 400 according to the present embodiment includes a diesel particulate filter (DPF) trap that is connected to a tailpipe 440 of an engine 20 that burns a hydrocarbon-based fuel supplied from a fuel storage tank 10, and collects and removes particulate materials within exhaust gas, such that the reduction system constitutes an exhaust gas after-treatment system. Further, the particulate material reduction system 400 includes a plasma reactor 250 having a gas inlet 263 and an outlet 262, and the DPF trap 30 having an oxidation catalyst 32 and a filter 35.

The tailpipe 440 of the engine 20 is connected to the DPF trap 30, and the outlet 262 of the plasma reactor 250 is connected to the tailpipe 440 that connects the engine 20 and the DPF trap 30. The plasma reactor 250 includes a first fuel inlet 281 and a second fuel inlet 291 that are positioned respectively at the front and back of an electrode 270, and the fuel inlets 281 and 291 are connected to the fuel storage tank 10.

Referring to FIG. 8, the plasma reactor 250 includes a body 260 providing a space for mixing and reaction, and the electrode 270 that is applied with a voltage for plasma discharge. The body 260 includes a reaction chamber 261 and a base 265, and the electrode 270 is supported by the base 265 and protrudes inside the reaction chamber 261.

The reaction chamber 261 is formed in a cylindrical shape having an inner space therein, and a gas inlet 263 and an outlet 262 are formed thereon. The gas inlet 263 is for inflow of gases such as air or exhaust gas, and the outlet 262 is for exhaust of reacted materials after plasma reaction. The gas inlet 263 may be formed to be open toward the side of the reaction chamber 261, and the outlet 262 may be open toward a side opposing the base 265.

The base 265 is formed at the lower end of the reaction chamber 261, and includes a mixing chamber 267 communicating with the gas inlet 263 and communicating with the reaction chamber 261 through an inflow hole 268.

A heat exchanging conduit 264 is formed in a wall body of the reaction chamber 261 to communicate the gas inlet 263 with the mixing chamber 267, the heat exchanging conduit 264 being spiral in form along a circumference of the reaction chamber 261. The gas having flowed in through the gas inlet 263 is transferred along the heat exchanging conduit 264, and may absorb heat that is transferred from the reaction chamber 261.

The inflow hole 268 is formed on the inner surface of the reaction chamber 261 to skew off at an angle to a normal line of the inner surface of the reaction chamber 261. Mixed fuel formed by mixing gas and fuel in the mixing chamber 267 flows into the reaction chamber 261 while forming a rotational flow and circulates around a circumference of the electrode 270, thereby forming a kind of swirl flow. The inflow hole 268 may be formed in plural at equal intervals, such that the inner space of the reaction chamber 261 can be utilized efficiently.

The reaction chamber 261 and the base 265 may be formed integrally, or may be assembled to each other after being manufactured separately. The base 265 may include an insulator such as ceramic to prevent electricity from flowing between the lower end of the electrode 270 and the reaction chamber 261.

The electrode 270 is supported by the base 265, and protrudes into the reaction chamber 261 while being apart from the inner surface of the reaction chamber 261. The electrode 270 is formed in a shape of a cone. The electrode 270 may have a neck at the lower part so as to form a broader space for reaction between the electrode 270 and the inner surface of the reaction chamber 261, thereby forming a congestion section of flame. The mixed fuel rotatably supplied through the inflow hole 268 moves around the circumference of the electrode 270 while forming a rotational flow in the reaction space. In this way, the plasma generated in the reaction space rotates therein to improve the plasma reaction efficiency in comparison with the former with the same volume. However, the electrode 270 may not have a neck, and the present invention is not limited thereto.

Meanwhile, in the plasma reactor 250 of the present embodiment, a first fuel inlet 276 is formed on the base 265 of the body 260 and a second fuel inlet 278 is formed on the reaction chamber 261. A first fuel injector 280 supplying liquid fuel into the mixing chamber 267 is fitted to the first fuel inlet 276, and a second fuel injector 290 supplying liquid fuel into the reaction chamber 261 is fitted to the second fuel inlet 278.

The first fuel inlet 276 is connected to a heating chamber 275, such that the first fuel injector 280 may spray and supply liquid fuel into the heating chamber 275. The sprayed liquid fuel is supplied into the mixing chamber 267 after being heated by the reaction chamber 261.

The second fuel injector 290 is fitted to skew at an angle to the inner surface of the reaction chamber 261 on the side thereof, and sprays and supplies liquid fuel above the electrode 270 inside the reaction chamber 261. Although it is not shown, the second fuel injector 290 may be fitted perpendicularly to the inner surface of the reaction chamber 261 on the side thereof.

FIG. 9 is a partial cross-sectional view illustrates the plasma reactor shown in FIG. 8 having an additional fuel injector.

The number of second fuel injectors 290 may be varied depending upon the size of the reaction chamber 261. One or more of the second fuel injectors 290 can be provided to the reaction chamber 261, and more than two may be arranged radially at equal intervals. In the present embodiment, as shown in FIG. 9, three of the second fuel injectors 290 are disposed at equal intervals. The liquid fuel, which is sprayed from the plurality of second fuel injectors 290 arranged radially at equal intervals, can collide to make smaller particles in the reaction chamber 261.

The second fuel injector 290 includes a second fuel supply conduit 291 and a second gas supply conduit 292. The second fuel supply conduit 291 is fixed on the base 265 of the body 260, and the second gas supply conduit 292 is fitted to a side of the second fuel supply conduit 291 while communicating therewith. The fuel supplied through the second fuel supply conduit 291 can be sprayed into the heating chamber 275 with the gas supplied through the second gas supply conduit 292. The gas supplied through the second gas supply conduit 292 may be from an exterior source of supply or a part of the exhaust gas. A conventional injector may alternatively be applied to the second fuel inlet 278 so as to spray liquid fuel directly.

Meanwhile, the liquid fuel sprayed through the second fuel injector 290 is burned to form a flame at the outlet 262 by the electrode 270 that is applied with a high voltage and plasma formed in the reaction chamber 261.

FIG. 10 is a cross-sectional view of the particulate material reduction system according to the fourth exemplary embodiment of the present invention, which illustrates a type of plasma reactor connected to a connection tailpipe.

Referring to FIG. 10, a connection tailpipe 441 for the plasma reactor 250 may be formed on the tailpipe 440 that connects the engine 20 and the DPF trap 30. The connection tailpipe 441 has a setting depression 443 that is depressed toward a central axis, to which the outlet 262 of the plasma reactor 250 is connected.

FIG. 11 is a cross-sectional view of the particulate material reduction system according to the fourth exemplary embodiment of the present invention, which illustrates another type of plasma reactor connected to a connection tailpipe, with a protection plate formed therein.

A protection plate 447 may be provided adjacent to the outlet 262 of the plasma reactor 250. The protection plate 447 is coupled to a setting depression 446 formed on the connection tailpipe 445 to protect the flame from a crosswind of the exhaust gas. It is desirable for the protection plate 447 to be located upstream of the exhaust gas flow before the outlet 262 of the plasma reactor 250.

Meanwhile, a third fuel injector 480 is fitted to a third fuel inlet 449 formed on a connection tailpipe 445 at a position corresponding to the plasma reactor 250.

The third fuel injector 480 sprays liquid fuel to the flame created at the plasma reactor 250 so as to supply gaseous fuel to the oxidation catalyst 32 of the DPF trap 30. The liquid fuel sprayed through the third fuel injector 480 is evaporated immediately by the flame 230 to become the gaseous fuel, and then the gaseous fuel is transferred to the oxidation catalyst 32 of the DPF trap 30 along the tailpipe 440. The third fuel injector 480 is connected to the fuel storage tank 10, and a conventional injector or nozzle may be applied for the third fuel injector 480. The third fuel injector 480 does not always need to be applied together with the protection plate 447. The third fuel injector 480 can be applied to the connection tailpipe 441 of FIG. 10, and further, it can be fitted to the tailpipe 440.

The operation of the particulate material reduction system according to the present embodiment will be described below, referring to FIG. 7 and FIG. 8.

The gas (air or exhaust gas), that flows in through the gas inlet 263 formed on a side of the reaction chamber 261 of the plasma reactor 250, is supplied into the mixing chamber 267 formed in the base 265, after being pre-heated while passing through the heat exchanging conduit 264 formed on the reaction chamber 261.

The gas flowed into the mixing chamber 267 is mixed with the liquid fuel supplied through the first fuel injector 280. That is, the liquid fuel supplied through the first fuel injector 280 is sprayed into the heating chamber 275 formed in the electrode 270, and the sprayed liquid fuel is supplied to the mixing chamber 267 after being pre-heated in the heating chamber 275.

The mixed fuel that is mixed in the mixing chamber 267 is supplied through the inflow hole 268 to form a rotational flow in the reaction chamber 261. The mixed fuel supplied as such circulates around a circumference of the electrode 270 to generate a rotating arc, thereby leading to plasma induced flame. Here, liquid fuel is supplied through the second fuel injector 290, and the liquid fuel is burned to form a flame at the outlet 262 by a high voltage applied to the electrode 270 and the plasma.

The flame may expand into the tailpipe 440 or the connection tailpipe 441 or 445 through the outlet 262 and supply heat for the exhaust gas transferred therethrough. If the exhaust gas is heated as such, particulate materials (PM) contained within the exhaust gas may be heated to a temperature at which the PM can be easily reacted at the oxidation catalyst 32 of the DPF trap 30.

Meanwhile, if the third fuel injector 480 is applied to the present embodiment, liquid fuel is sprayed to the flame formed at the outlet 262 through the third fuel injector 480, and then the liquid fuel is evaporated to contribute to an increase in temperature by oxidation at the oxidation catalyst 32 of the DPF trap 30.

FIG. 12 is a schematic diagram of a particulate material reduction system according to a fifth exemplary embodiment of the present invention, and FIG. 13 is a schematic diagram of a particulate material reduction system according to a sixth exemplary embodiment of the present invention.

As shown in FIG. 12, a particulate material reduction system 500 according to the present embodiment includes a DPF trap that is connected to a tailpipe 540 of an engine 20 that burns a hydrocarbon-based fuel supplied from a fuel storage tank 10, and collects and removes particulate materials within exhaust gas, such that the reduction system constitutes an exhaust gas after-treatment system. Further, the particulate material reduction system 500 includes a plasma reactor 350 having a gas inlet 363 and an outlet 362, and a DPF trap 30 having an oxidation catalyst 32 and a filter 35.

The tailpipe 540 of the engine 20 is connected to the DPF trap 30, and the outlet 362 of the plasma reactor 350 is connected to the tailpipe 540 connecting the engine 20 and the DPF trap 30. The plasma reactor 350 includes a fuel inlet 376 at the back of the electrode 370, and the fuel inlet 376 is connected to the fuel storage tank 10.

In the present embodiment, the electrode 370 includes a spray nozzle 373 through which the inside of the reaction chamber 361 is communicated with the heating chamber 375. Referring to FIG. 14, the spray nozzle 373 of the electrode 370 is formed to skew off at an angle to an exterior surface of the electrode 370. One or more spray nozzles 373 may be provided to the electrode 370, and more than two may be arranged radially at equal intervals.

When the plasma reactor 350 is operated, a high voltage may be applied to the electrode 370. The fuel sprayed from the spray nozzle 373 formed on the electrode 370 is burned by plasma generated in the reaction chamber 361 to form a flame at the outlet 362.

Features of the present embodiment that have not been described in detail or otherwise are similar to the plasma reactor of the fourth exemplary embodiment.

FIG. 15 is a cross-sectional view of the particulate material reduction system according to the fifth exemplary embodiment of the present invention, which illustrates a type of plasma reactor connected to a connection tailpipe.

Referring to FIG. 15, a connection tailpipe 541 for the plasma reactor 350 may be formed on the tailpipe 540 that connects the engine 20 and the DPF trap 30. The connection tailpipe 541 has a setting depression 543 depressed toward a central axis, to which the outlet 362 of the plasma reactor 350 is connected.

The operation of the particulate material reduction system according to the present embodiment will be described below, referring to FIG. 12 and FIG. 13.

The air that flows in through the gas inlet 363 formed on a side of the reaction chamber 361 of the plasma reactor 350 is supplied into the mixing chamber 367 formed in the base 365, after being pre-heated while passing through the heat exchanging conduit 364 formed on the reaction chamber 361. The air having flowed into the mixing chamber 367 is mixed with the liquid fuel supplied through the fuel injector 380.

The liquid fuel supplied through the fuel injector 380 is sprayed into the heating chamber 375 formed in the electrode 370, and a part of the sprayed liquid fuel is supplied to the mixing chamber 367 after being pre-heated in the heating chamber 375 while and the rest is sprayed to the reaction chamber 361 through the spray nozzle 373.

The mixed fuel that is mixed in the mixing chamber 367 is supplied through the inflow hole 368 to form a rotational flow in the reaction chamber 361. The mixed fuel supplied as such circulates around a circumference of the electrode 370 to generate a rotating arc, thereby leading to plasma. Here, liquid fuel is supplied through the spray nozzle 373 of the electrode 370, and the liquid fuel is burned to form a flame at the outlet 362 by a high voltage applied to the electrode 370 and the plasma.

The flame may expand into the tailpipe 540 or the connection tailpipe 541 through the outlet 362 and supply heat for the exhaust gas transferred therethrough. If the exhaust gas is heated as such, particulate materials (PM) contained within the exhaust gas may be heated to a temperature at which the PM can be easily reacted at the oxidation catalyst 32 of the DPF trap 30.

FIG. 16 is a schematic diagram of a particulate material reduction system according to a sixth exemplary embodiment of the present invention.

A particulate material reduction system 600 according to the present embodiment is similar to that of the fifth exemplary embodiment. However, exhaust gas flows into the plasma reactor 350 since the gas inlet 363 of the plasma reactor 350 is connected to the tailpipe 640 of the engine 20.

FIG. 17 is a cross-sectional view of the particulate material reduction system according to a seventh exemplary embodiment of the present invention, which illustrates a type of plasma reactor connected to a connection tailpipe, with a protection plate formed therein.

In the plasma reactor 450 applied to the particulate material reduction system 700 according to the present embodiment, the electrode 470 includes a spray nozzle 473 through which an inside of the reaction chamber 461 is communicated with the heating chamber 475. In this way, the plasma reactor 450, which is similar to the plasma reactor of the fourth exemplary embodiment, includes fuel inlets 476 and 478 that are positioned respectively at the front and back of the electrode 470. The fuel inlets 476 and 478 are provided with fuel injectors 480 and 490 connected to the fuel storage tank, and liquid fuel can be sprayed into the heating chamber 475 or the reaction chamber 461 therewith.

Meanwhile, a protection plate 747 may be provided adjacent to the outlet 462 of the plasma reactor 450. The protection plate 747 is coupled to the setting depression 743 formed on the connection tailpipe 741 to make the flame stable from a crosswind of the exhaust gas.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

The invention claimed is:

1. A reduction system for particulate materials in exhaust gas, which is connected to a tailpipe of an engine that burns a hydrocarbon-based fuel supplied from a fuel storage tank, and collects and removes particulate materials in the exhaust gas, the reduction system comprising:

a plasma reactor having an inlet for gas and an outlet, a fuel inlet and the fuel inlet is connected to the fuel storage tank, a body including a reaction chamber having the gas inlet and the outlet and a base formed at the lower end of the reaction chamber, the base including a mixing chamber communicating with the gas inlet and communicating with the reaction chamber via an inflow hole, and an electrode protruding into the reaction chamber while being supported by the base and being spaced apart from the inner surface of the reaction chamber, wherein the fuel inlet is formed on the base of the body and a heating chamber is formed in the electrode, the heating chamber communicating with the mixing chamber and the fuel inlet being connected to the heating chamber, and wherein the inflow hole is formed on the inner surface of the reaction chamber to skew off at an angle to a normal line of the inner surface of the reaction chamber, wherein mixed fuel formed by mixing gas and fuel in the mixing chamber flows into the reaction chamber through the inflow hole while forming a rotational flow and circulates around a circumference of the electrode, and a DPF (diesel particulate filter) trap having a filter, wherein the tailpipe of the engine communicates with the DPF trap and the outlet of the plasma reactor communicates with the tailpipe that connects the engine and the DPF trap, and wherein the system is configured so that fuel injected through the fuel inlet is plasma-reacted in the plasma reactor such that the fuel is burned to raise the temperature of the exhaust gas, and is transferred to the DPF trap.

2. The reduction system of claim 1, wherein the plasma reactor further comprises a first fuel injector being fitted to a first fuel inlet formed on the base of the body and spraying liquid fuel into the heating chamber, and a second fuel injector being fitted to a second fuel inlet connected to the reaction chamber and spraying liquid fuel into the reaction chamber.

3. The reduction system of claim 2, wherein the second fuel injector is fitted to skew off at an angle to the inner surface of the reaction chamber on the side thereof, and sprays and supplies liquid fuel above the electrode inside the reaction chamber.

4. The reduction system of claim 2, wherein the first fuel injector and the second fuel injector are connected to the fuel storage tank.

5. The reduction system of claim 2, wherein a protection plate is provided adjacent to the outlet of the plasma reactor in the tailpipe to block crosswind of the exhaust gas.

6. The reduction system of claim 5, wherein the protection plate is located at an upstream side of the exhaust gas before the outlet of the plasma reactor.

7. The reduction system of claim 2, further comprising a third fuel injector fitted to a third fuel inlet formed on the tailpipe at a position corresponding to the plasma reactor.

8. The reduction system of claim 2, wherein a heat exchanging conduit is formed in a wall body of the reaction chamber to communicate the gas inlet with the mixing chamber, the heat exchanging conduit being spiral in form along a circumference of the reaction chamber.

9. The reduction system of claim 1, wherein the plasma reactor includes a fuel injector fitted to the fuel inlet that is connected to the heating chamber of the electrode, the fuel injector spraying and supplying liquid fuel into the heating chamber, and wherein the electrode includes a spray nozzle through which the inside of the reaction chamber is communicated with the heating chamber.

10. The reduction system of claim 9, wherein the spray nozzle of the electrode is formed to skew off at an angle to an exterior surface of the electrode.

11. The reduction system of claim 9, wherein a heat exchanging conduit is formed in a wall body of the reaction chamber to communicate the gas inlet with the mixing chamber, the heat exchanging conduit being spiral in form along a circumference of the reaction chamber.

12. The reduction system of claim 1, wherein the tailpipe of the engine is branched off and communicates with the DPF trap and the inlet for gas of the plasma reactor, and wherein a part of the exhaust gas exhausted from the engine is transferred to the DPF trap after being heated while passing through the plasma reactor.

13. The reduction system of claim 12, wherein the system is configured so that fuel injected through the fuel inlet is plasma-reacted in the reaction chamber together with the exhaust gas flowing in through the gas inlet, such that the fuel is burned to raise the temperature of the exhaust gas, and is transferred to the DPF trap.

14. The reduction system of claim 1, wherein a heat exchanging conduit is formed in a wall body of the reaction chamber to communicate the gas inlet with the mixing chamber, the heat exchanging conduit being spiral in form along a circumference of the reaction chamber.

15. The reduction system of claim 1, wherein a fuel supply conduit fixed to the base of the body is fitted to the fuel inlet, and a gas supply conduit is fitted to a side of the fuel supply conduit while communicating with each other, thereby spraying the fuel supplied through the fuel supply conduit into the heating chamber with the gas supplied through the gas supply conduit.

* * * * *